US005233775A

United States Patent [19]

Dieckmann

[11] Patent Number: 5,233,775

[45] Date of Patent: Aug. 10, 1993

[54] HAMMER COCKING ARRANGEMENT FOR BREAK-OPEN FIREARM

[75] Inventor: Ralf E. Dieckmann, Phoenix, Ariz.

[73] Assignee: Sturm Ruger & Company, Inc., Southport, Conn.

[21] Appl. No.: 897,230

[22] Filed: Jun. 11, 1992

[51] Int. Cl.[5] ..... F41A 3/58

[52] U.S. Cl. ..... 42/43; 42/45

[58] Field of Search ..... 42/43, 45

[56] References Cited

U.S. PATENT DOCUMENTS 1,094,729 4/1914 Lewis ..... 42/43

1,578,639 3/1926 Browning ..... 42/43

2,333,043 10/1943 Roemer ..... 42/43

4,964,232 10/1990 Mainland et al. ..... 42/45

FOREIGN PATENT DOCUMENTS 50427 10/1911 Austria ..... 42/43

692902 11/1930 France ..... 42/43

*Primary Examiner*—Stephen M. Johnson

*Attorney, Agent, or Firm*—Pennie & Edmonds

[57] ABSTRACT

A break-open firearm having an improved cocking mechanism in which the hammer strut is extended to interact with the cocking rod without an intermediate energy-consuming arrangement.

4 Claims, 4 Drawing Sheets

HAMMER COCKING ARRANGEMENT FOR BREAK-OPEN FIREARM

BACKGROUND OF THE INVENTION

Numerous arrangements have been proposed for cocking the hammers of breakdown or break open firearms (U.S. Pat. Nos. 767,557; 714,193; 840,507; and 1,143,612).

In all prior art arrangements, one of the main factors making cocking of a break-open firearm difficult, has been excessive friction between the numerous working parts. Usually, a cocking rod operates against a portion of an an intermediate member, which in turn forces the hammer back against the force of the hammer spring. Prior art arrangements, to date, have not provided a simple and easy to operate system which allows the cocking rod to operate directly against the hammer strut, thereby substantially reducing friction and easing the cocking effort considerably.

SUMMARY OF THE INVENTION

It is therefore a general object of the present invention to provide a cocking mechanism which will overcome the above prior art shortcomings as well as other disadvantages of prior art cocking mechanisms.

It is the principal object of the present invention to substantially reduce the physical effort necessary to cock the hammers of break-open firearms. It is also an object of the present invention to provide a hammer and hammer strut assembly in which features of the hammer and hammer strut serve to keep said components in close mechanical relationship with each other and without fear that said hammer and hammer strut become misaligned with each other.

It is a further object of the present invention to reduce the number of parts necessary to accomplish the cocking of the hammers of break-open firearms.

Briefly, the present invention comprises a break-open mechanism in which a cocking rod is translated by a camming arrangement as the barrel-forend assembly and frame-stock assembly of the firearm are pivoted with respect to one another. The translated cocking rod acts directly on an extension of the hammer strut which projects forward of the hammer to compress the hammer spring. The hammer is pivotable to its cocked position by application of a small force exerted by the hammer strut extension as the hammer spring is beeing compressed by the cocking rod translation.

DESCRIPTION OF THE PREFERRED EMBODIMENTS

In order to simply the description of the prior art and present invention firearms, only one cocking and firing mechanism will be described even though the firearms shown have two barrels and would normally require another substantially identical cocking and firing mechanism.

Figure 1:
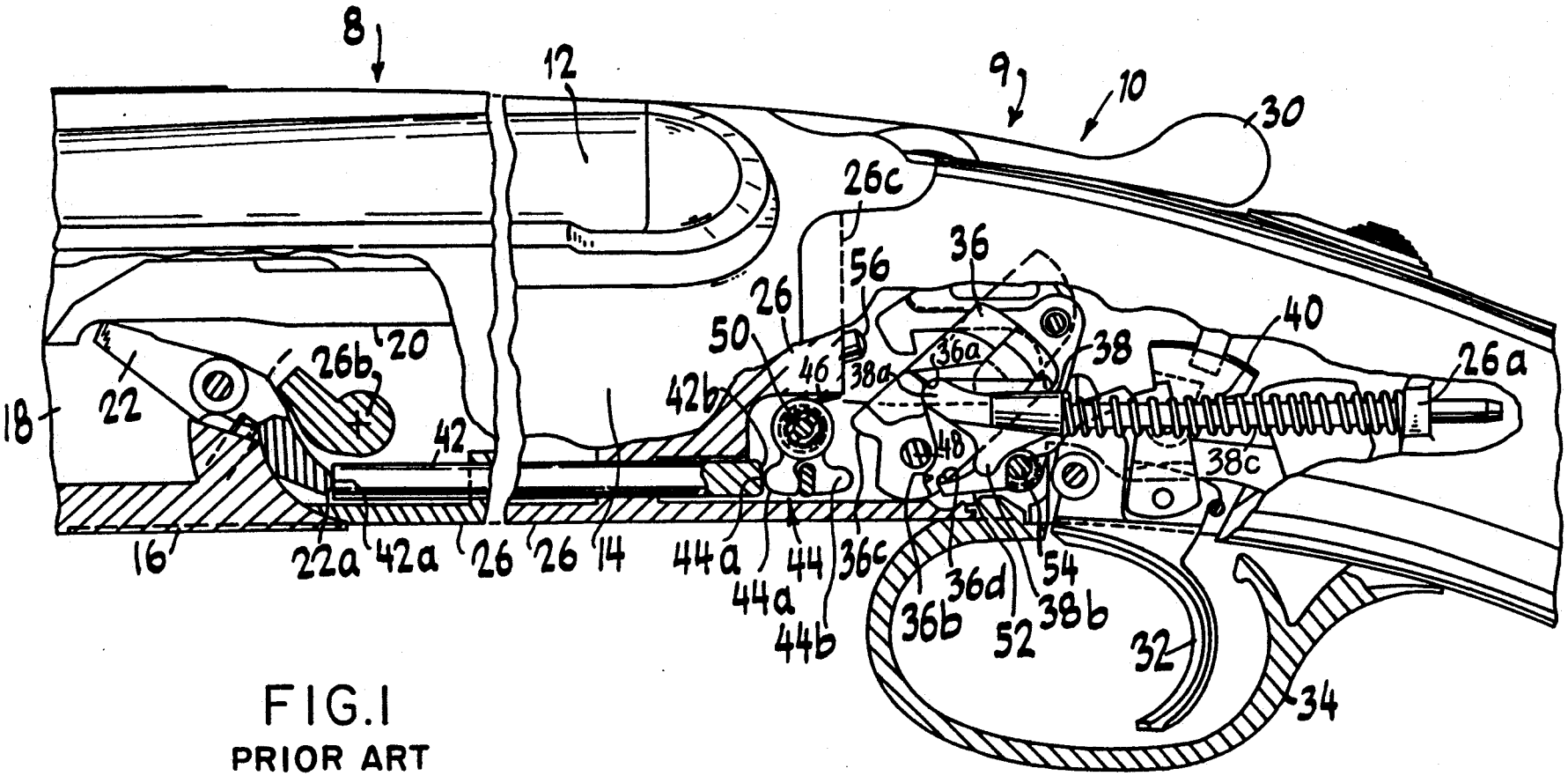
FIG. 1 PRIOR ART
FIG. 1 is a partial cutaway elevational view of a prior art shotgun showing a cocked hammer and hammer strut mechanism.
Figure 2:
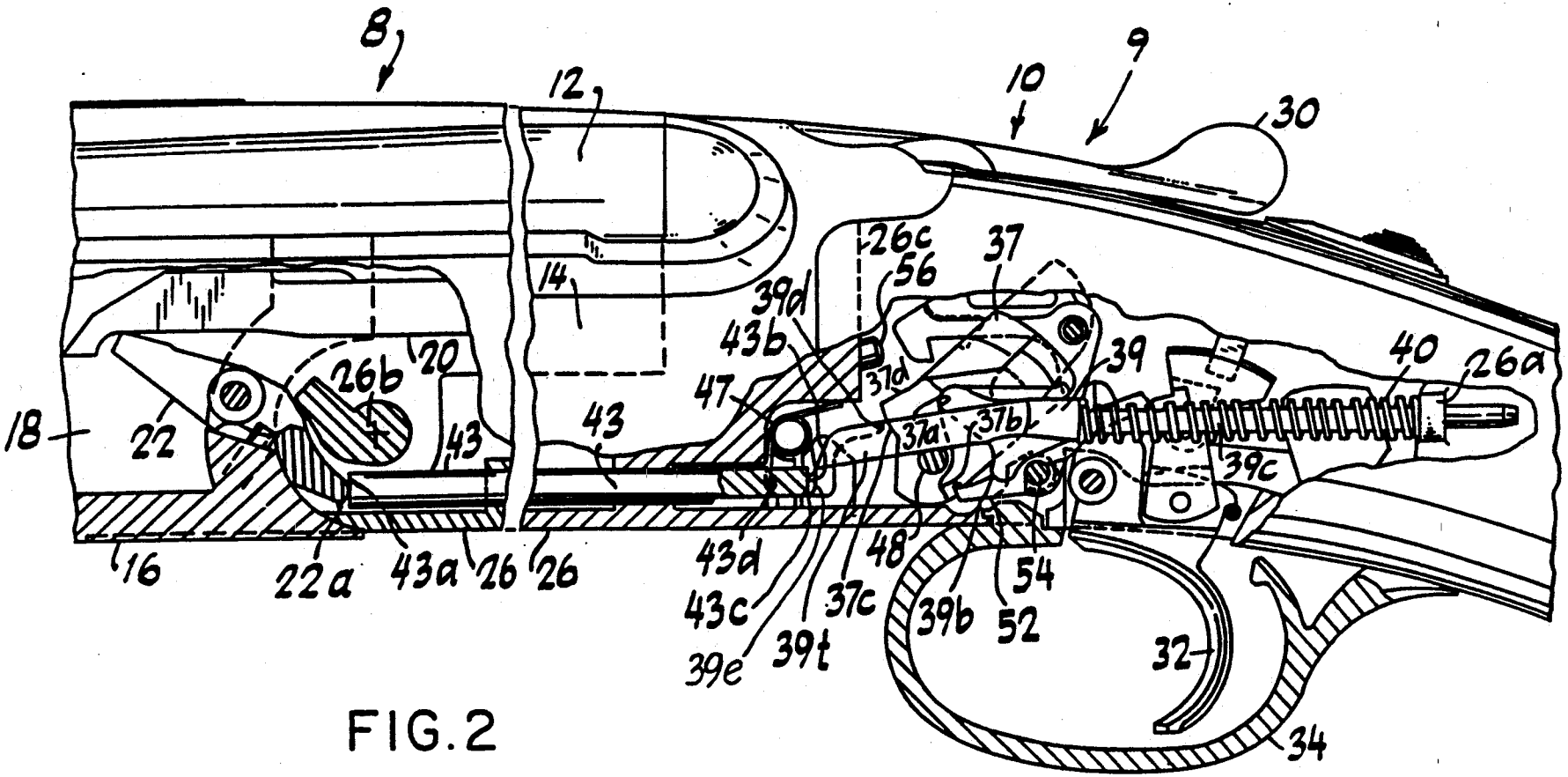
FIG. 2 is a partial cutaway elevational view of the present invention, showing a cocked hammer and hammer strut mechanism.

Referring now to the drawings and particularly to the prior art firearm of FIG. 1, firearm 10 includes a barrel-forend assembly 8 arranged for pivotal motion upon a frame-stock assembly 9. Barrel-forend assembly 8 includes upper barrel 12, lower barrel 14, forend 18, forend iron 16 and ejector/extractor 20 which will not be mentioned further in the description. Frame-stock assembly 9 includes frame 26, stock (not shown) top lever 30, trigger 32 and trigger guard 34 which will also not be mentioned further in the description.

Starting with the prior art firearm in the battery position, the cocking of hammer 36 is accomplished by pivoting barrel-forend assembly 8 about theoretical center **26*b*** in a counterclockwise direction. The hinge means (not shown) allowing said counterclockwise rotation, will not be explained further, as it is well known to those skilled in the art.

As the barrel-forend assembly 8 is rotated counterclockwise, nose **22*a* of ejector sear 22 is forced against first end 42*a* of cocking rod 42 translating the latter to the right until second end 42*b* of cocking rod 42 contacts first cam 44*a* of cocking member 44. Ejector sear 22 is held rigid relative to forend iron 16 by the resistance of hammer spring 40 and rotates with barrel-forend assembly 8. The pivotal function of ejector sear 22 is used during the extraction/ejection cycle and does not pertain to the present descriptions. Cocking member 44 is thus rotated about pivot 50 in a counterclockwise direction, causing second cam 44*b* of cocking member 44 to be forced against nose 36*c* of hammer 36. The latter is now forced to rotate about pivot 48 in a clockwise direction. Hammer strut 38, whose first lobe 38*a* rests in first pocket 36*a* of hammer 36, is thus forced to the right, compressing hammer spring 40 against abutment 26*a* of frame 25. An aperture in abutment 26*a* guides hammer strut rod 38*c* of hammer strut 38. The cocking cycle is completed, when sear 52, biased about pivot 54 in a clockwise direction engages sear notch 36*d* of hammer 36. When barrel-forend assembly 8 is rotated clockwise, back to the battery position, spring 46, which has been tensioned during the cocking cycle, forces cocking member 44 to rotate in a clockwise direction, returning it to the position which it occupied before the cocking cycle started. In so doing, first cam 44*a* forces cocking rod 42** to the left until it also is returned to the position it occupied before the cocking cycle started.

Referring now to FIGS. 2, 3, 4, 5 and 6, the firearm 10 of the present invention includes a barrel-forend assembly 8 arranged for pivotal motion upon a frame-stock assembly 9. Barrel-forend assembly 8 includes upper barrel 12, lower barrel 14, forend 18, forend iron 16 and ejector/extractor 20. Frame-stock assembly 9 includes frame 26, stock, (not shown), top lever 30, trigger 32 and trigger guard 34.

Starting with the battery position, the cocking of hammer 37 is accomplished by pivoting barrel-forend assembly 8 about theoretical center 26*b* of frame 26 in a counter clockwise direction. This action forces nose 22*a* of ejector sear 22 against first end 43*a* of cocking rod 43 and translates the latter to the right until second end 43*b* contacts surface 39*e* of hammer strut 39, forcing the latter also to the right. As barrel-forend assembly 8 continues to be rotated, hammer strut 39 compresses hammer spring 40 against abutment 26*a* of frame 26. An aperture in abutment 26*a* guides hammer strut rod 39*c*. Hammer strut 39 includes hammer strut extension 39 t.

Figure 3:
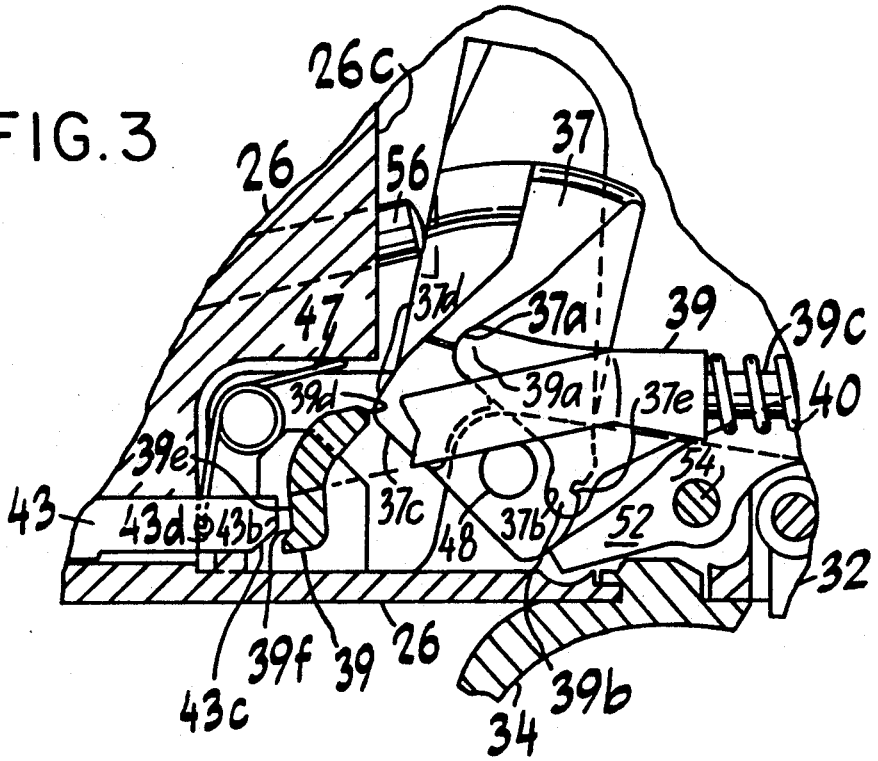
FIG. 3 is a partial elevational view of the present invention showing the hammer at rest.
Figure 4:
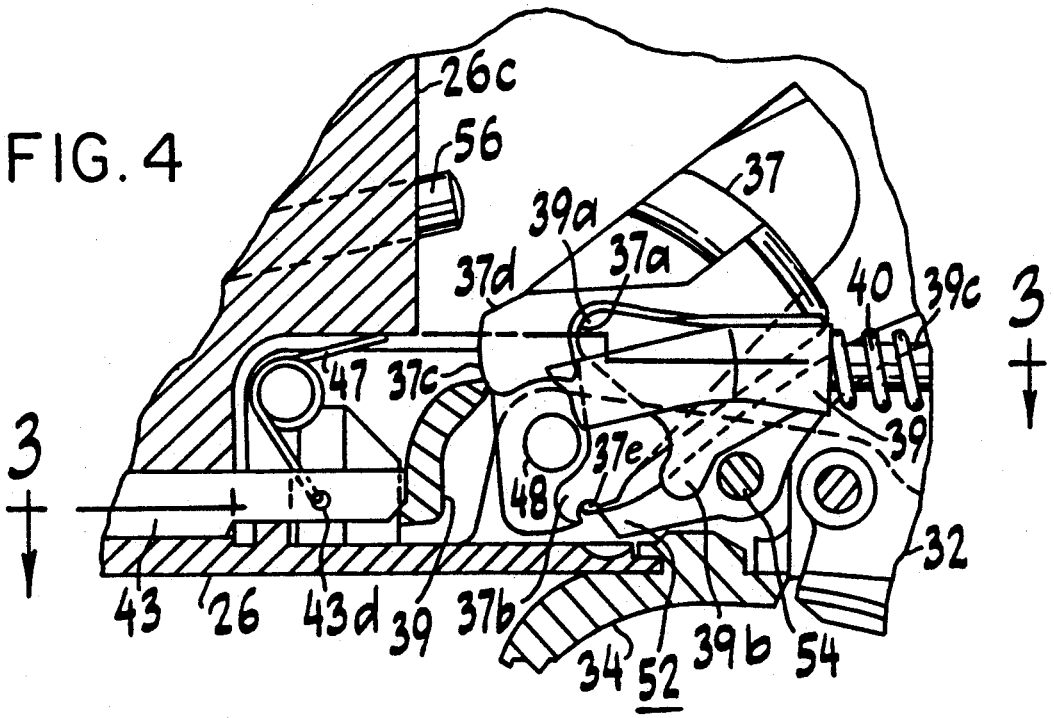
FIG. 4 is a partial elevational view of he present invention showing the hammer fully cocked while the cocking rod is still in its rearmost position, i.e. the barrel is open.

While hammer 36 in the prior art firearm had to be rotated against the force of hammer spring 40 to be cocked, hammer 37 of the present invention has only to be "nudged" to the cocked position, resisting only with its mass. This is accomplished as follows:

Turning to FIGS. 3 and 4, just prior to the translation to the right of hammer strut 39, a small clearance gap exists between nose 39*d* of hammer strut 39 and cam radius 37*c* of hammer 37, while first and second lobes 39*a* and 39*b* respectively of hammer strut 39 are firmly seated in first and second pockets 37*a* and 37*b* respectively of hammer 37. As hammer strut 39 is forced to the right its nose 39*d* in hammer strut extension 39*t* contacts cam radius 37*c* of hammer 37. This motion creates a small clearance gap between first and second lobes 39*a* and 39*b* respectively of hammer strut 39 and first and second pockets 37*a* and 37*b* respectively of hammer 37 thus removing the force of hammer spring 40 completely from hammer 37. As hammer strut 39 continues to be forced to the right its nose 39*d* gently pushes or "nudges" hammer 37 in a clockwise direction through contact with cam radius 37*c*. Importantly, the center of cam radius 37*c* coincides with the center of first pocket 37*a* of hammer 37. As the cocking cycle continues, and hammer 37 continues to be rotated, first lobe 39*a* will continue to remain in first pocket 37*a* without applying the force of hammer spring 40 to hammer 37. When hammer 37 has been "nudged" to the cocked position in this manner, sear 52, biased about pivot 54 in a clockwise direction, engages sear notch 37*e* and thus prevents any subsequent counterclockwise rotation of hammer 37.

An additional feature of the above described cocking mechanism is angled mating surface 43*c* and 39*f* of cocking rod 43 and hammer strut 39 respectively. Because of the fact that hammer spring 40 exerts its force above second end 43*b* of cocking rod 43 and surface 39*e* of hammer strut 39 to the latter would tend to pivot clockwise, having as its center of rotation the intersection of the center line of hammer strut rod 39*c* and the left abutment surface of abutment 26*a* when cocking rod 43 applies a force to hammer strut 39. If this were to occur, the engagement of nose 39*d* of hammer strut 39 and cam radius 37*c* of hammer 37 would not be assured. Angled mating surfaces 43*c* and 39*f* prevent the problem by vertical engagement with one another during the cocking cycle.

The release of hammer 37 to fire a cartridge is prior art, with the exception of control surface 37*d* of hammer 37, the function of which is as follows: As barrel-forend assembly 8 is returned to the battery position, the force against surface 39*e* of hammer strut 39 is removed, allowing hammer spring 40 to force hammer strut 39 to the left, until first lobe 39*a* makes contact with first pocket 37*a* of hammer 37. At this point hammer 37 is subject to the full force of hammer spring 40. Also, the small clearance gap between nose 39*d* and cam radius 37*c* has been reestablished. Cocking rod return spring 47 which has been tensioned during the cocking cycle by engagement with bore 43*d* of cocking rod 43 now returns the latter to the position it occupied before the start of the cocking cycle, thus creating a large gap between second end 43*b* of cocking rod 43 and surface 39*e* of hammer strut 39. When hammer 37 is released by disengaging sear 52 from sear notch 37*e*, hammer spring 40, through engagement of first lobe 39*a* of hammer strut 39 in first pocket 37*a* of hammer 37, drives the latter in a counterclockwise direction toward firing pin 56. When hammer 37 reaches its "at rest" or rebound position, second lobe 39*b* of hammer strut 39 will seat in second pocket 37*b* of hammer 37 and hammer spring 40 will have taken a position of greatest expansion and least tension.

Figure 6:
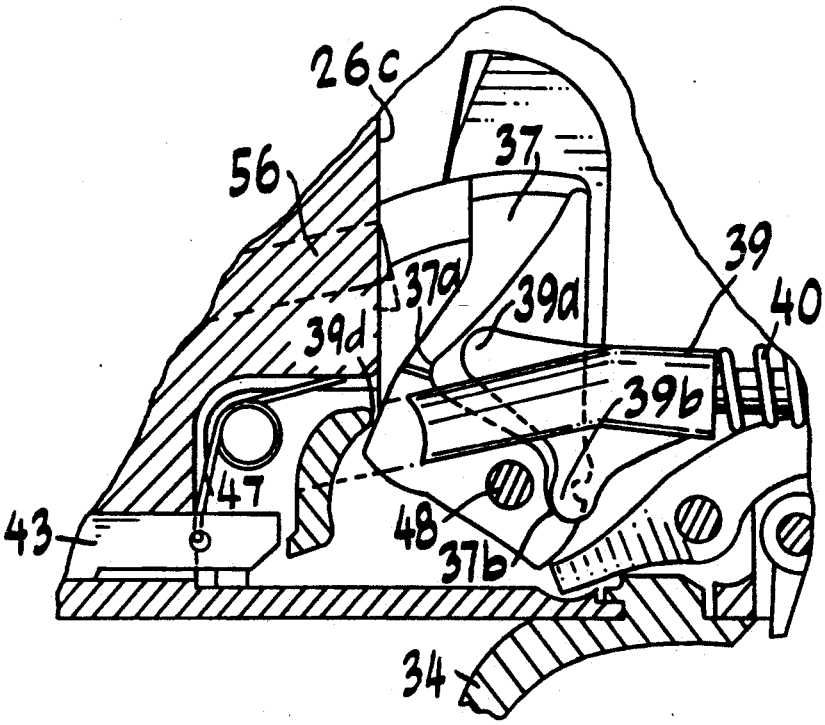
FIG. 6 is a partial elevational view of the present invention, showing the hammer in the striking position at the instant of firing a cartridge.

Theoretically, the counterclockwise rotation of hammer 37 would stop at this point because continued counterclockwise rotation of hammer 37 would require the unseating of first lobe 39*a* from first pocket 37*a* and the compression of hammer spring 40. However, because of the inertia of the moving mass of hammer 37, this is precisely what takes place. Hammer 37 continues to rotate until it is stopped by surface 26*c* of frame 26 thus driving firing pin 56 toward the cartridge (FIG. 6). Now that energy stored in pivoting hammer 37 has been expended, hammer spring 40, which has been compressed slightly rotates hammer 37 in a clockwise direction through engagement of second lobe 39*b* of hammer strut 39 in second pocket 37*b* of hammer 37 until first and second lobes 39*a* and 39*b* are resting in first and second pockets 37*a* and 37*b* of hammer 37. In the above description, when hammer 37 rotates in a counterclockwise direction, from the rebound position to the striking position, surface 37*d* passes in close proximity, without contact, of nose 39*d* of hammer strut 39. As can be understood from the foregoing description, nose 39*d* of hammer strut 39, cam radius 37*c* and control surface 37*d*, both of hammer 37, assure that first lobe 39*a* of hammer strut 39 is captured in first pocket 37*a* of hammer 37 during the cocking cycle while releasing second lobe 39*b* of hammer strut 39 from second pocket 37*b* of hammer 37 and that second lobe 39*b* of hammer strut 39 is captured in second pocket 37*b* of hammer 37 while releasing first lobe 39*a* of hammer strut 39 from first pocket 37*a* of hammer 37 during that part of the firing cycle which takes places in a counterclockwise direction from the rebound or "at rest" position and that both, first and second lobes 39*a* and 39*b* respectively of hammer strut 39 are captured in both, first and second pockets 37*a* and 37*b* respectively of hammer 37 in the rebound or "at rest" position.

Figure 5:
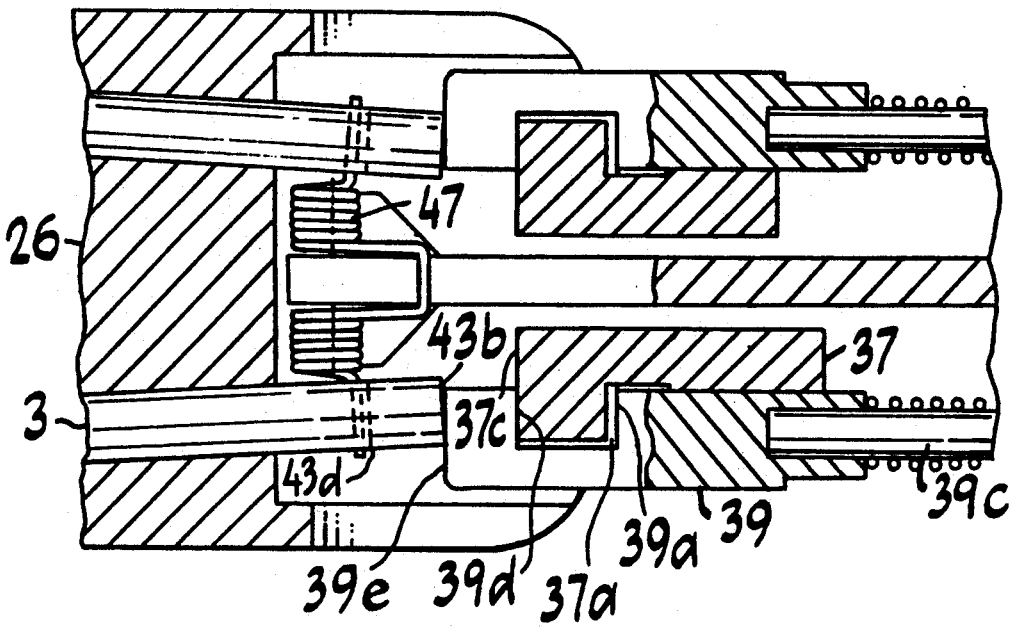
FIG. 5 is a sectional view of FIG. 4 taken along line 3—3.

In a two barrel firearm with two hammers the above described arrangement exists for each hammer (FIG. 5).

I claim:

1. In a break open firearm having a stock frame, a barrel housing carrying a barrel rotatable about a pivot on the stock frame, a hammer pivotally mounted on the stock frame for movement from a cocked position to a position against the stock frame acted on by a hammer strut, a hammer spring urging the hammer strut forwardly, a firing pin protruding from a frame surface, a cocking rod mounted for reciprocation on the stock frame for acting on said hammer strut, cam means on the barrel housing for moving the cocking rod rearward when the barrel housing is rotated about the frame, the improvement comprising a. an elongated hammer strut extension means forming part of said hammer strut with said strut extension means extending forward of the hammer;

b. a foot means on said elongated extension means for surface-to-surface engagement with the cocking rod; and c. hammer engaging pusher means on the hammer strut extension means for pushing the hammer rearward to position the hammer in a cocked position as the elongated extension is acted on by the reciprocating cocking rod.

2. The firearm of claim 1 in which the foot means includes a suitably shaped surface and the cocking rod a complementary surface for engagement between said surfaces.

3. The firearm of claim 1 in which the hammer includes a recess with a recess wall and the hammer strut includes a strut head having a lobe engaging the hammer recess wall to urge the hammer forward.

4. The firearm of claim 1 in which the hammer has two spaced-apart recesses and the hammer strut includes a strut head having two spaced-apart lobes which said recesses and lobes are configured to permit the hammer to rotate under force of the strut head for part of its downward movement from its cocked position to its position against the frame with the remainder of its downward movement by inertia and thereafter said hammer moves toward its cocked position under urging of the strut head to cause the hammer to be selectively oriented spaced from the frame surface.

* * * * *